US005217776A

United States Patent [19]

Tilby

[11] Patent Number: 5,217,776

[45] Date of Patent: Jun. 8, 1993

[54] STRUCTURAL PANEL AND BUILDING FORMS

[76] Inventor: Sydney E. Tilby, 4688 Boulderwood Dr., Victoria, B.C., Canada, V8Y 2P8

[21] Appl. No.: 637,480

[22] Filed: Jan. 4, 1991

[51] Int. Cl.[5] ..... B32B 5/16; B32B 21/02

[52] U.S. Cl. ..... 428/61; 428/120; 428/219; 428/220; 428/528; 428/537.1

[58] Field of Search ..... 428/58, 120, 219, 220, 428/528, 61, 537.1; 156/62.2

[56] References Cited

U.S. PATENT DOCUMENTS

| | | | |
|---|---|---|---|
| 2,592,470 | 4/1952 | Ryberg | 156/501 |
| 2,648,262 | 8/1953 | Croston et al. | 162/290 |
| 2,717,420 | 9/1955 | Roy | 264/119 |
| 2,853,413 | 9/1958 | Christian | 428/113 |
| 3,164,511 | 1/1965 | Elmendorf | 428/110 |
| 3,464,877 | 9/1969 | Miller et al. | 156/259 |
| 3,464,881 | 9/1969 | Miller et al. | 428/105 |
| 3,567,511 | 3/1971 | Tilby | 127/43 |
| 3,690,358 | 9/1972 | Tilby | 241/62 |
| 4,025,278 | 5/1977 | Tilby | 425/404 |
| 4,212,616 | 7/1980 | Tilby | 425/256 |
| 4,312,677 | 1/1982 | Tilby et al. | 127/2 |
| 4,610,913 | 9/1986 | Barnes | 428/528 |

*Primary Examiner*—Alexander S. Thomas
*Attorney, Agent, or Firm*—Jansson & Shupe, Ltd.

[57] ABSTRACT

An improved structural panel made from the rinds of sugarcane and other similar grasses. The panel is formed of a pile of rind fiber-bundle strands randomly oriented in substantially parallel planes. The strands are substantially straight and of length such that most have a stalk node thereon. Each strand has a multiplicity of contact points with other strands of the pile, and a binder coats the strands and interconnects them at the contact points to form a substantially rigid structure, the coated strands defining voids within the pile.

19 Claims, 3 Drawing Sheets

STRUCTURAL PANEL AND BUILDING FORMS

FIELD OF THE INVENTION

This invention is related generally to building materials and, more particularly, to wall and ceiling panels made of natural plant fibers like the woody rinds of grasses such as sugarcane and sweet sorghum.

BACKGROUND OF THE INVENTION

Many kinds of board products have been made from woody plant fibers in the form of chips, slabs, strands, shreds, particles, sawdust, shavings, comminutions, and other fiber forms. Such fibrous materials have been bound together using a variety of binders and forming methods to produce boards or panels referred to as chipboard, particle board, fiberboard, strand board, woodwool board, veneer board, and pressboard, to name just some.

It is known that the woody rinds of grasses such as sugarcane and sweet sorghum can be used in producing some of such boards. Additionally, it is known that such rinds, that is, the fibers from such rinds, can be aligned and bonded to form boards having characteristics much like solid natural hardwood.

United States patents have been granted on various improvements relating to the above-noted manufactured panels and boards, including the following U.S. Pat. Nos.

2,592,470 (Ryberg)
2,648,262 (Croston et al.)
2,717,420 (Roy)
2,853,413 (Christian)
3,164,511 (Elmendorf)
3,464,881 (Miller et al.)
3,464,877 (Miller et al.)
3,567,511 (Tilby)
3,690,358 (Tilby)
4,025,278 (Tilby)
4,212,616 (Tilby)
4,312,677 (Tilby et al.).

While a few of these patents relate to the solid boards mentioned above, most relate to boards and panels which are lighter and less expensive. A long-standing problem or shortcoming of the latter boards and panels is their inherent weakness. Because of this, few of such boards and panels have significant weight-bearing and structural characteristics, such boards and panels often serving lesser covering, underlying, or decorative needs. Often such boards and panels have little ability to serve in situations exposing them to weather, because weakening can occur.

In many cases, the strength of such panels and boards is provided primarily by the binder rather than by the fibers used in manufacture. In some cases, a degree of strength is achieved by the degree of packing. In others, the use of large amounts of binder per unit volume of product increases the cost of such panels.

Such panels not only are lacking in structural strength, but typically do not have good insulating qualities. Because of this the usefulness of such panels is often quite limited.

Manufacture of such panels and boards has been carried out in various methods, some requiring complex extrusion equipment or other manufacturing equipment. The processes used in making such panels and boards often require extended periods to achieve drying throughout the cross-section of the board or panel, and significant amounts of energy.

A major problem in many developing countries and elsewhere is the shortage of high-quality building materials or, stated differently, the high cost of materials used for various building needs, including residential housing. In many cases, locally manufactured materials may not be available, requiring importation which adds to costs.

In summary, there is a clear need for low-cost, high-strength structural panels which are light in weight, have good load-bearing qualities, good insulative qualities, and good weather-resistance.

OBJECTS OF THE INVENTION

It is an object of this invention to provide an improved structural panel overcoming some of the problems and shortcomings of boards and panels of the prior art.

Another object of this invention is to provide an improved structural panel having excellent load-bearing properties.

Another object of this invention is to provide an improved structural panel which is light in weight and inexpensive to produce.

Another object of this invention is to provide a structural panel made of grasses having woody rinds, such as sugarcane and sorghum.

Another object of this invention is to provide a structural panel which may be manufactured at low cost in many developing countries, where there is a substantial need for such materials.

Still another object of this invention is to provide improved low-cost building forms.

These and other important objects will be apparent from the descriptions of this invention which follow.

SUMMARY OF THE INVENTION

This invention is a structural panel made from the rinds of grasses selected from the group consisting of sugarcane and sweet sorghum, i.e., those grasses having woody rinds surrounding a pithy center. While some panel boards have been disclosed as made with such woody rinds, the panels of this invention have significantly improved structural characteristics, while being light in weight and fairly easy to produce.

The structural panel of this invention is formed of a pile of rind fiber-bundle strands which are randomly oriented in substantially parallel planes. The strands are substantially straight and of sufficient length such that most have a stalk node thereon. Each strand has a multiplicity of contact points therealong with other strands of the pile, and a binder which coats the strands interconnects them at such contact points to form a substantially rigid structure. The coated interconnected strands define voids within the pile.

Strand length and substantial straightness are matters of considerable importance. The strands are made of rind fiber bundles, a term used to describe narrow strips of dried woody sugarcane or sorghum rind which, e.g., are split away from half-billet rinds in sugarcane or sweet sorghum processing using the so-called Tilby separation system. Very short, very thin, and/or very curly strands are not usable in the structural panel of this invention; such strands would not impart the structural strength which is an important characteristic of this invention.

That is, each strand is preferably at least 15 cm long, while a length of 20–30 cm is very highly preferred as offering the best panel qualities. Such fiber-bundle strands, which have a thickness equal to the thickness of the sugarcane or sorghum rind, are preferably at least about 0.10 cm wide, while widths of about 0.15–0.40 cm are very highly preferred. Dimensions of this general order will assure that the fiber-bundle strands are substantially straight as required.

The binder in the structural panel of this invention is preferably a cured thermosetting formaldehyde-based condensation polymer. Most preferably, the polymer is a water-resistant amino-formaldehyde polymer. In preferred embodiments, about 5–20% of the weight of the panel will be binder, an amount well below that used in other fibrous panels. The amount of binder is such that it need not be seen in the finished panel.

The structural panel of this invention is very light in weight, preferably having a density as low as about 0.15–0.25 g/cc. This sets this invention apart from a number of panel products of the prior art. Yet the panel of this invention has superior structural qualities.

In the structural panel of this invention, the voids mentioned above are sufficient to allow air flow through the pile. This is so even though the structural panel of this invention is quite thick when compared to many panels and boards of the prior art. The ability to permit significant air flow not only characterizes the invention, it is also a quality of vital importance to production of the panel, as will be pointed out later.

As already noted, the structural panel of this invention is quite thick. Preferably, the thickness of such panel is at least about 5 cm, and most preferably about 7.5 cm. Thicker or thinner panels, of course, have greater or lesser degrees of strength.

In certain highly preferred embodiments of this invention, a layer is applied to a side of the panel to form a panel surface. Such layers may be applied to both sides. In such cases, the unfilled voids between the plaster-like (or other) surfaces of the panel provide significant insulating qualities in the structural panel of this invention.

A variety of materials, including materials applied as a sheet and materials applied as a paste or the like, may be used for such surface layers. One highly preferred material is a plaster-like surface material which extends into voids of the pile. Such a surface material is firmly locked in place because it is applied as a paste or other flowable material and when cured or dried firmly engages the strand formation. Such material preferably forms both surfaces of the panel. Such structural panels, having both surfaces treated in the manner just described, have significantly enhanced structural strength.

The structural panel of this invention may be used in certain simple building forms which make the invention particularly advantageous. Such building forms are a significant aspect of this invention.

One of these is a panel of the type described above joined together in an edge-to-edge juncture with a second similar panel. In certain preferred embodiments, such juncture includes a mortar-like material along the edges extending into the voids of each of the panel edges. In another form, a structural panel as described above has its side joined to the edge of a similar panel in an edge-to-side juncture, again using a mortar-like material extending into the voids of the pile along the joint.

A pair of structural panels as described may be interconnected in edge-to-edge relationship along a juncture with at least one of the sides of each panel substantially coplanar with one of the sides of the other panel. A mesh strip, such as either fiberglass or wire mesh, is placed in contact with the coplanar sides of such two panels in a position spanning the juncture of such panels. A plaster-like surface material covers the coplanar sides and the mesh strip to interconnect such panels while providing a continuous covered surface. As in the joints described above, the plaster-like material extends into the voids of the pile, with all the attendant advantages. Both faces of the side-by-side panels preferably have substantially coplanar surfaces joined in the manner described.

Likewise, one panel can have an edge abutting the face of another panel and be attached in a generally similar manner. More specifically, an angled juncture can be interconnected along the surface by means of either one angled mesh strip or a pair of such strips placed in contact with the angled sides and spanning the juncture of such panels, on either one side or opposite sides. A plaster-like surface material covers the angled sides and the mesh strip and interconnects such panels, such plaster-like material extending into the voids of the pile.

A number of variations of such forms can be made using the teachings of this invention.

DETAILED DESCRIPTIONS OF PREFERRED EMBODIMENTS

Figure 1:
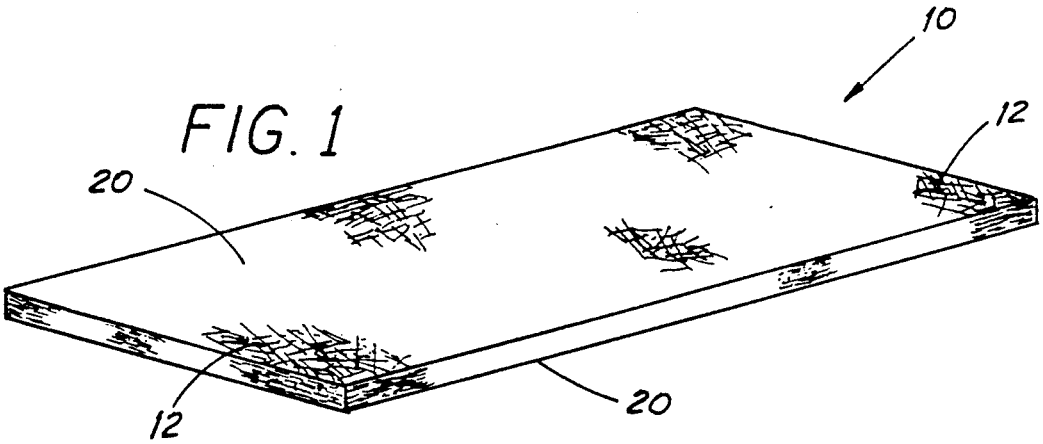
FIG. 1 is a perspective view of a structural panel in accordance with this invention.
Figure 2:
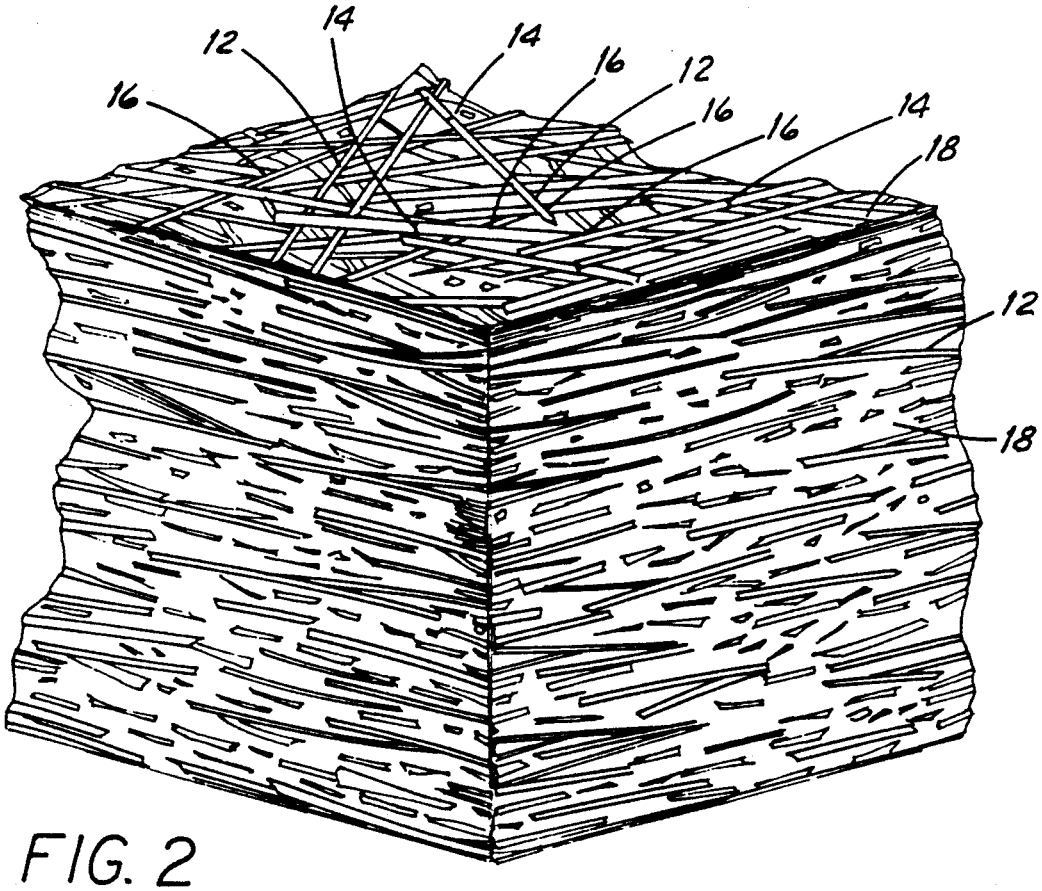
FIG. 2 is an enlarged (actual size) fragmentary perspective.

FIGS. 1 and 2 show a structural panel 10 made in accordance with this invention. Panel 10 may be about 244 cm long, 122 cm wide, and about 7.6 cm thick (4 feet by 8 feet by 3 inches), or any other size useful in particular constructions. At such dimensions, panel 10 offers excellent structural and load-bearing qualities when compared to many panels of the prior art.

FIG. 2 serves to better illustrate some of the details of panel 10. Panel 10 is made from a pile of rind fiber-bundle strands 12 which are taken from the rinds of woody grass selected from the group consisting of sugarcane and sweet sorghum. Strands 12 of the pile are randomly oriented in substantially parallel planes.

While reference throughout this application is made primarily to sugarcane, it is to be understood that such references are in no sense limiting. Fiber-bundle strands of any woody grass as described may be used.

Strands 12 are substantially straight and are long enough that most have a stalk node 14 somewhere along their lengths. Strands 12 are made from the woody rinds of billets of sugarcane or sweet sorghum stalk. Such billets, while cut without reference to the location of stalk nodes, are cut of sufficient length such that, given the range of natural spacings between such stalk nodes, most billets and hence most strands have a stalk node somewhere along their lengths.

To be even more specific, it is preferred that rind fiber-bundle strands 12 be at least about 15 cm long, and most preferably about 20–30 cm long.

The straightness of fiber-bundle strands 12 requires that they not be mere shreds or shavings, but instead substantially rigid pieces of woody rind. Preferred dimensions of strands 12 having such straightness include a thickness equal to the thickness of the rinds from which they are slit and a width of at least about 0.10 cm. Highly preferred widths are about 0.15–0.40 cm, such widths allowing maintenance of good strand straightness even for strands within the preferred range of 20–30 cm in length.

As already noted, strands 12 which constitute panel 10 are randomly oriented in substantially parallel planes. Each strand 12 has a large number of contact points 16 along its length, such contacting strands being interconnected at such points by a binder.

The binder of structural panel 10 is preferably a cured thermosetting formaldehyde-based condensation polymer which coats each strand 12 and interconnects it to other strands of the pile at the very great number of random contact points 16 throughout the pile. Examples of suitable condensation polymers are phenol-formaldehyde and melamine-formaldehyde. The most highly preferred polymers are water-resistant amino-formaldehyde polymers, such as melamine-formaldehyde. A particularly preferred polymer composition of the latter type has about 60% melamine and 40% formaldehyde.

Structural panel 10 preferably includes about 5–20% binder by weight of the panel. Thus, structural panel 10 obtains its strength not from the amount of binder used, but from strands 12 and the interconnection of such strands at contact points 16.

Given all these factors, structural panel 10 has significant voids 18 throughout its thickness 10, as can easily be seen in FIGS. 1 and 2. This openness is sufficient to allow air to be moved through the pile, a processing advantage. And, when both of the sides 20 of panel 10 have covering layers thereon, as hereafter described, a dead space is created therebetween which provides excellent insulating qualities.

Voids 18 also allow structural panel 10 to be light in weight. Panel 10 panel preferably has an average density of only about 0.15–0.25 g/cc.

Figure 3:
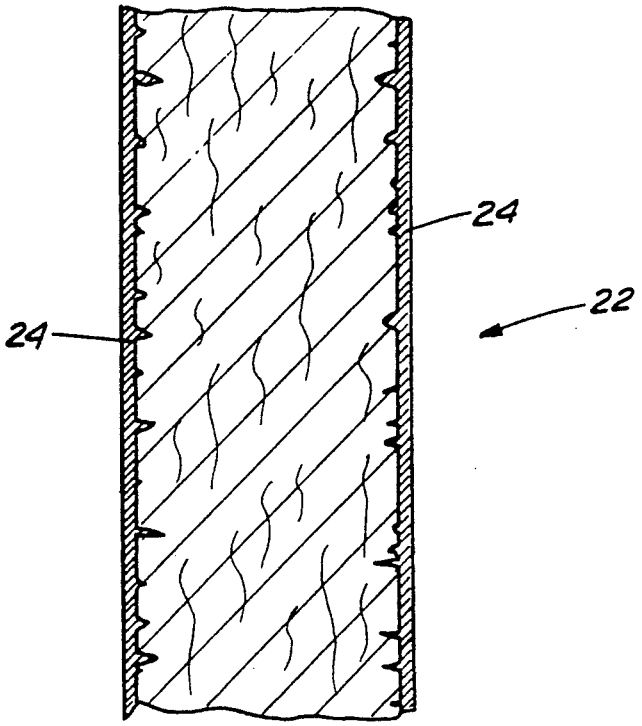
FIG. 3 is a cross-section of a panel in accordance with this invention, having plaster-like surface layers on its opposite sides.

FIG. 3 illustrates a structural panel 22 which is similar in every respect to the panels of FIGS. 1 and 2 except that it includes a plaster-like surface material 24 on both sides. Such material, which is preferably common plaster, extends into voids 18, allowing it to form a firm bond with the remainder of panel 22.

Referring again to the random orientation of strands 12 in substantially parallel planes, such planes are preferably at a slight angle with respect to the surface of panel 10. That is, rather than being fully parallel to such surface, most of strands 12 are in planes which are slightly tilted. Such angling occurs by virtue of the manufacturing process which involves depositing strands 12 in a pile on a moving belt, and later greatly compressing such pile on a continuous basis during curing of the binder.

Figure 4:
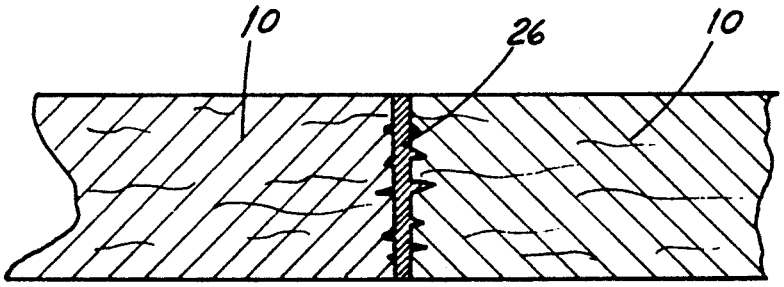
FIG. 4 is an edge-to-edge joint of two adjacent panels of the type shown in FIG. 1.
Figure 5:
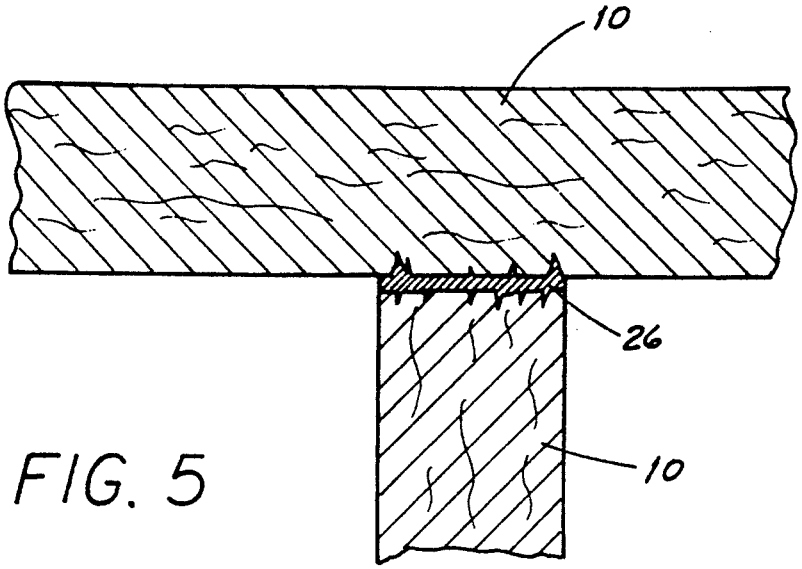
FIG. 5 is an edge-to-side joint.

FIG. 4 illustrates an edge-to-edge junction of two structural panels 10, including a mortar-like material 26 which extends into the aforementioned voids to form a firm joint. A suitable example of such material is common mortar, in its various forms. However, a wide variety of other materials can be used. FIG. 5 shows an edge-to-side joint using the same material.

Figure 6:
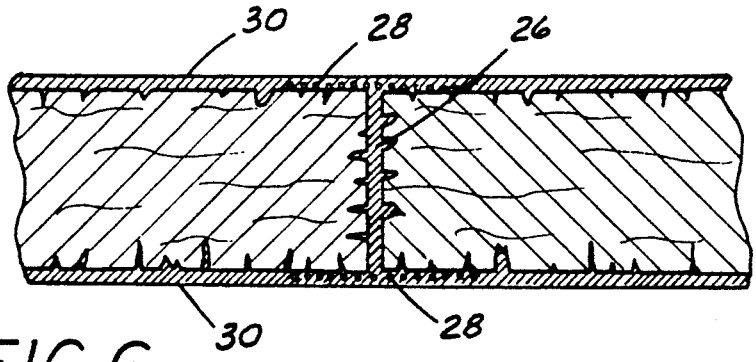
FIG. 6 is an edge-to-edge joint using mesh on both sides.
Figure 7:
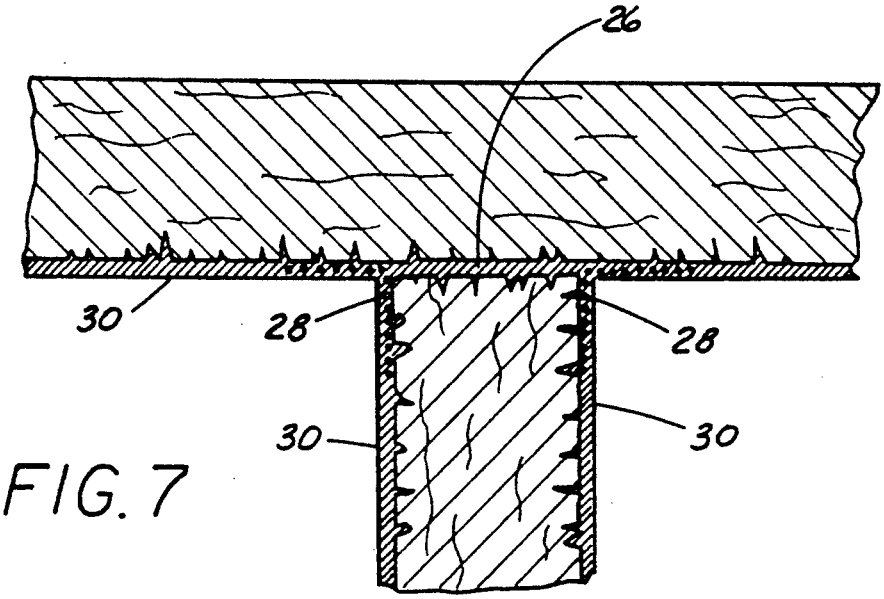
FIG. 7 is a similar edge-to-side joint.

FIGS. 6 and 7 illustrate another form of joint, including an edge-to-edge joint and an edge-to-side joint, respectively. While each includes mortar-like material 26 in the positions previously described, each also has a mesh 28 spanning the junction at the surfaces of such building forms and then a plaster-like surface material 30 covering mesh 28 and extending along the panel surfaces adjacent thereto. This form of joint provides substantial strength and has obvious appearance advantages. An alternative is to use plaster-like surface material 30 in the positions where mortar-like material 26 is shown.

Structural panels 10 and 22 can be used for walls and ceilings of buildings without the necessity for a full complement of wall studs, ceiling joists and the like, as is common. Buildings having substantial structural stability can be built in this manner. Properly constructed, such buildings can have the ability to withstand hurricane-force winds. When used as a ceiling, or for other purposes, structural panel 10, rather than having an extra layer or layers as is shown in FIG. 3 can simply have one or both of its sides spray-painted. Ceiling panels having this look, in addition to having an good appearance, have excellent acoustical qualities.

Structural panel 10 may be made by: providing a loose collection of substantially straight rind fiber-bundle strands 12 of length such that most have a stalk node 14 thereon, as described above; coating strands 12 with an uncured binder, such as those noted above; depositing the coated strands on a surface in a loose pile of first thickness with strands 12 randomly oriented in substantially parallel planes; pressing such loose pile to a substantially lesser final thickness with strands 12 still in substantially parallel planes; and curing the binder to interconnect each strand with other strands at a multiplicity of contact points 16 along its length, the interconnected strands forming voids within the pile.

In highly preferred embodiments, the curing step includes moving air through the pile to quickly cure the binder. The air moving through the pile is preferably at temperatures substantially elevated above ambient. For example, a temperature of about 400 degrees Fahrenheit may be used, depending on various factors including the binder chosen.

In preferred embodiments, the surface on which the strands are deposited is a moving conveyor. The pressing step involves advancing the pile with and between an opposed pair of converging perforated belts, one of which is the moving conveyor, the belt pair having a downstream end at which the belts are spaced apart by the final thickness.

The step of moving drying air through the pile is done by blowing air through the perforated belts and the pile held therebetween. This is preferably done by first blowing moist air through the pile and then drier air. Such order of treatment avoids early formation of a skin which might impede drying and/or otherwise harm product quality. Preferably, a single air stream is directed to pass repeatedly through the pile, the stream moving generally in a direction counter to the direction of movement of the conveyor. Such air stream picks up moisture during such counter movement, to achieve the desired drying characteristics.

While the principles of this invention have been described in connection with specific embodiments, it should be understood clearly that these descriptions are made only by way of example and are not intended to limit the scope of the invention.

I claim:

1. A structural panel made from the rinds of grasses selected from the group consisting of sugarcane and sweet sorghum comprising:

a pile of rind fiber-bundle strands randomly oriented in substantially parallel planes, the strands substantially straight and of length such that most have a stalk node thereon, each strand having a multiplicity of contact points therealong with other strands of the pile; and about 5–20%, by weight of the panel, of a binder coating the strands and interconnecting them at the contact points to form a substantially rigid structure, the coated interconnected strands defining substantial voids within the pile such that the panel has an average density of about 0.15–0.25 g/cc;

whereby the panel is usable for walls and ceilings without the necessity of a full complement of wall studs and ceiling joists.

2. The structural panel of claim 1 wherein the binder is a cured thermosetting formaldehyde-based condensation polymer.

3. The structural panel of claim 2 wherein the polymer is a water-resistant amino-formaldehyde polymer.

4. The structural panel of claim 1 wherein the voids are sufficient to allow air flow through the pile.

5. The structural panel of claim 1 having a thickness of at least about 5 cm.

6. The structural panel of claim 1 wherein the strands are at least about 15 cm long and at least about 0.10 cm wide.

7. The structural panel of claim 6 wherein the strands are about 20–30 cm long and about 0.15–0.40 cm wide.

8. The structural panel of claim 1 wherein the panel has opposite sides and further comprising a layer applied on at least one side to form a panel surface.

9. The structural panel of claim 8 wherein the layer is a plaster-like surface material extending into voids of the pile.

10. The structural panel of claim 9 wherein the panel has such plaster-like surface material on both sides.

11. The structural panel of claim 1 having an edge and joined together at an edge-to-edge juncture with a second similar structural panel.

12. The structural panel of claim 11 wherein the edge-to-edge junction includes a mortar-like material along the edges and extending into the voids of the pile.

13. The structural panel of claim 1 having opposite sides and an edge and joined together at an edge-to-side juncture with a second similar structural panel.

14. The structural panel of claim 13 wherein the edge-to-side juncture includes a mortar-like material extending into the voids of the pile.

15. An interconnected pair of the structural panels of claim 1 comprising:

each such panel having opposite sides and a first edge, such panels aligned in edge-to-edge relationship along a juncture with at least one of the sides of each panel substantially coplanar with one of the sides of the other panel;

a mesh strip in contact with the coplanar sides and spanning the juncture of such panels; and a plaster-like surface material covering the coplanar sides and the mesh strip to form the interconnection of such panels, such plaster-like material extending into the voids of the pile.

16. The interconnected pair of structural panels of claim 15 wherein the mesh strip is wire mesh.

17. The interconnected pair of structural panels of claim 16 comprising:

both sides of each panel substantially coplanar with corresponding sides of the other panel;

a pair of such mesh strips, one on each side of the interconnected panels; and the plaster-like surface material covering the coplanar sides and mesh strips on each side of the interconnected panels.

18. An interconnected pair of the structural panels of claim 1 comprising:

each such panel having opposite sides and a first edge, such panels aligned in edge-to-side relationship along a juncture with at least one of the sides of each panel angled with respect to one of the sides of the other panel;

an angled mesh strip in contact with the angled sides and spanning the juncture of such panels; and a plaster-like surface material covering the angled sides and the mesh strip to form the interconnection of such panels, such plaster-like material extending into the voids of the pile.

19. An interconnected pair of the structural panels of claim 18 wherein the mesh strip is wire mesh.

* * * * *